United States Patent [19]

McGinnis

[11] Patent Number: 4,850,161

[45] Date of Patent: Jul. 25, 1989

[54] EXTENSIBLE MAST SUPPORT SYSTEM

[76] Inventor: Henry J. McGinnis, P.O. Box 7773, Fort Worth, Tex. 76111

[21] Appl. No.: 126,500

[22] Filed: Nov. 30, 1987

[51] Int. Cl.[4] ..... E04H 12/18; E04H 12/20

[52] U.S. Cl. ..... 52/108; 52/111

[58] Field of Search ..... 52/108, 111, 146, 149, 52/745; 242/54 A

[56] References Cited

U.S. PATENT DOCUMENTS

| | | | |
|---|---|---|---|
| 1,656,215 | 1/1928 | McDonald et al. | 52/108 |
| 2,130,993 | 9/1938 | Dubilier | 52/108 |
| 2,923,382 | 2/1960 | Heldstab | 52/149 X |
| 4,625,475 | 12/1986 | McGinnis | 52/108 |

FOREIGN PATENT DOCUMENTS

| | | | |
|---|---|---|---|
| 707479 | 4/1965 | Canada | 52/146 |

*Primary Examiner*—John E. Murtagh
*Assistant Examiner*—Anthony W. Williams
*Attorney, Agent, or Firm*—James E. Bradley

[57] ABSTRACT

An extensible mast support system is depicted which utilizes a plurality of anchor points which are disposed radially distant from the base of the mast. A support bracket mounted to the mast serves to mount multiple metering sprockets and a single continuous length of cable is threaded between each anchor point and the support bracket. Strain measurement devices on each span of the cable are utilized to control the length of cable payed out during extension or retraction of the mast. A beaded cable which engages the metering sprockets is utilized to restrict variations in length between spans whereby increased strain in an individual span will not vary the length of the other spans and the mast will remain vertical.

20 Claims, 4 Drawing Sheets

EXTENSIBLE MAST SUPPORT SYSTEM

BACKGROUND OF THE INVENTION

1. Field of the Invention:

This invention relates in general to extensible and retractable masts and specifically to support systems for anchoring such masts.

Extensible and retractable masts are well known in the prior art. Such devices are typically utilized in communications to support antennae, fruit harvesting, fire hose elevation and many other applications in which temporary elevation or support is required. Known portable mast systems generally utilize telescoping or other extension methods and many such systems include masts which are mounted upon a portable base or trailer to facilitate movement of the mast from location to location.

2. Description of the Prior Art:

An excellent example of the current state of the art in portable extensible mast systems can be seen in U.S. Pat. No. 4,625,475 issued to Henry J. McGinnis. The system disclosed in that patent teaches an extensible mast which is formed by orienting and uniting flexible strips of material.

A problem which exists in all known extensible mast systems is the provision of stability as the mast is deployed or retracted. Guy wire systems are well known in the art; however, unlike fixed mast units which may be simply supported by fixed guy wires, an extensible system requires a guy wire system which can be continually adjusted as the mast is deployed. The solution utilized by most extensible mast systems known in the prior art involves the utilization of multiple guy wires which must be individually controlled to ensure vertical stability of the mast. The problems associated with accurately controlling multiple individual guy wires have made erection of such systems unduly complex and such systems often require a large number of assistants to operate.

It should therefore be apparent that a need exists for an extensible mast support system which may be simply and easily utilized to provide stability for an erect mast. Further, a need exists for an extensible mast support system which may be adapted to provide continual stability during both extension and retraction of a portable mast.

SUMMARY OF THE INVENTION

It is therefore one object of the present invention to provide an improved extensible mast support system.

It is another object of the present invention to provide an improved extensible mast support system which provides vertical stability during extension and retraction of the mast.

It is yet another object of the present invention to provide an improved extensible mast support system which provides vertical stability during extension and retraction of the mast and which may be easily and simply operated by a single operator.

The foregoing objects are achieved as is now described. The extensible mast system of the present invention includes a plurality of anchor points which are preferably disposed at equidistant points radially distant from the base of the mast. A support bracket is mounted to the mast and serves as a mounting point for multiple metering sprockets. A single continuous length of cable is threaded from a single supply reel coupling each anchor point and the support bracket. A plurality of strain measurement devices are utilized to measure the strain on each span of cable between an anchor point and the support bracket and the output of these strain measurement devices is utilized to control the paying out of cable during mast extension and retraction. The length of cable utilized is beaded with a plurality of beads which engage with the metering sprockets to restrict variations in length between spans despite variations in strain from span to span. In this manner, the geometry of the guy wires is retained despite the utilization of a single continuous length of cable and vertical stability is ensured.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
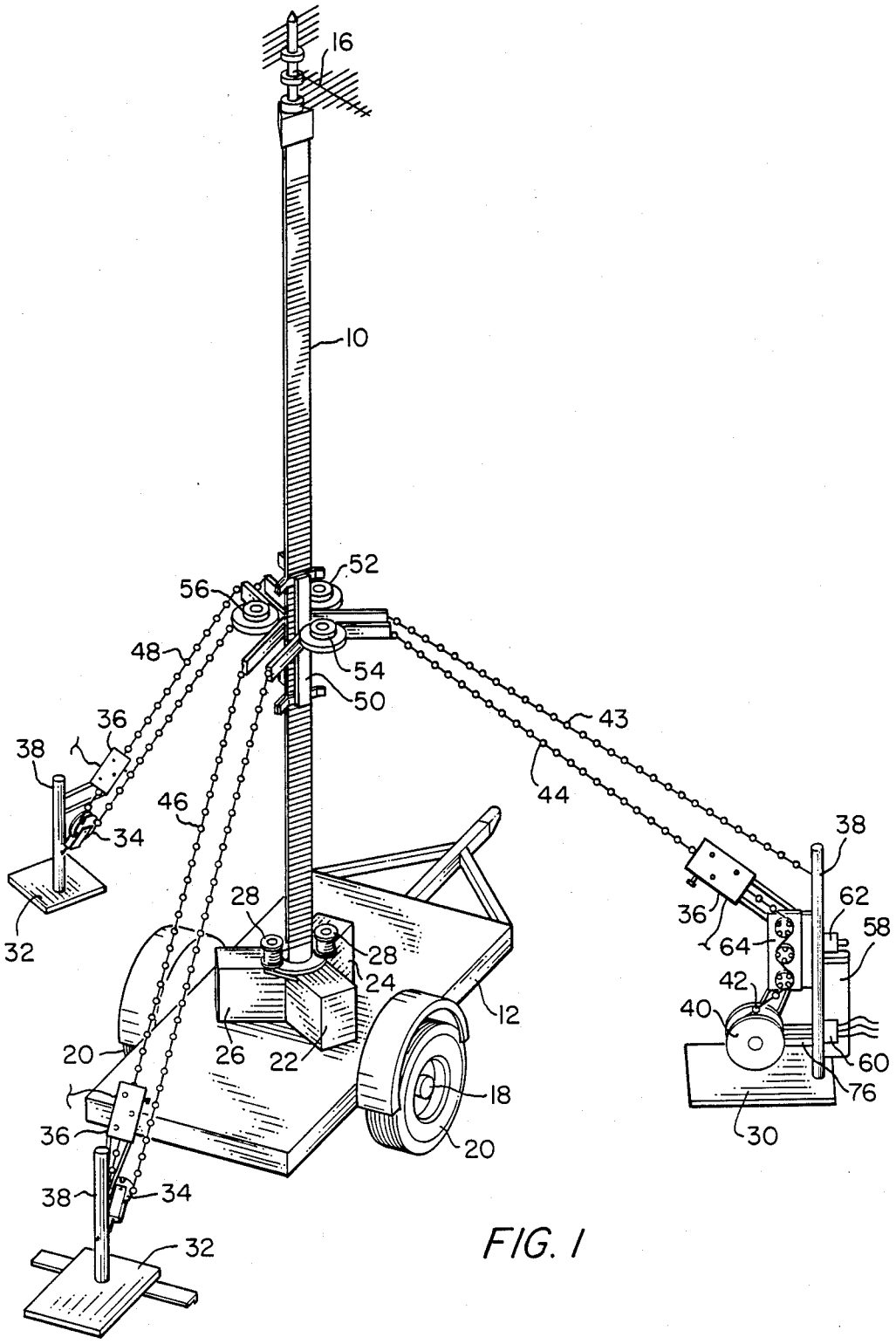
FIG. 1 is a perspective view of a portable extensible mast system utilizing the support system of the present invention.

With reference now to the figures and in particular with reference to FIG. 1, there is depicted a perspective view of a portable extensible mast system which utilizes the support system of the present invention. As can be seen, the portable mast system includes a mast 10 which has been erected from a movable base 12 to support a communications antennae 16. In the depicted embodiment movable base 12 is implemented utilizing a small trailer having an axle 18 and wheels 20 so that mast 10 may be moved from site to site prior to erection. As is taught in the McGinnis Patent, mast 10 may be erected utilizing a plurality of flexible metal members which are coiled within reel housings 22, 24 and 26. To ensure additional structural soundness in the depicted mast system, rotatable reels 28 are utilized to Wrap mast 10 in an elongate flexible material of a type and nature disclosed in the aforementioned patent.

The support system of the present invention utilizes a plurality of anchors including cable supply anchor base 30 and two additional anchor bases 32. Each anchor base 30 or 32 is preferably placed at a radially disposed location which is equidistant from the base of mast 10. Additionally, each anchor base 30 or 32 is radially spaced equally about mast 10. That is, with three anchor bases as depicted, each base is located at a one hundred and twenty degree angle from an adjacent anchor base. While three anchors are depicted in this embodiment, upon reference to this specification those skilled in the art will appreciate that at least two anchors must be utilized and that any greater number may also be utilized in accordance with the teaching of the present invention. Additionally, it should be clear that multiple sets of anchors may be utilized, each set serving to anchor a different vertical section of mast 10. It should also be apparent that many methods exist for anchoring anchor bases 30 or 32 to the earth.

Upon each anchor base 30 or 32 there is mounted a stanchion 38 which serves to support additional system elements. Cable supply anchor base 30 and its associated stanchion 38 serve to support supply reel 40 which is utilized to store and collect cable 42. In the depicted embodiment of the present invention cable 42 comprises a flexible metallic cable which includes a plurality of beads 66 which are formed thereon at substantially equidistant locations. The function of beads 66 will be explained in greater detail herein; however, it will be apparent that other physical discontinuities in cable 42, if utilized in accordance with the novel system of the present invention, may serve a similar function to that of beads 66.

Cable supply anchor base 30 also serves to support controllable drive motor 58 which is preferably an electric motor. Controllable drive motor 58, through transmission 62, and as directed by control device 60, serves, in a manner described below, to operate cable drive 64. Also mounted to each cable supply anchor base 30, and anchor bases 32, are strain measurement devices 36 which are utilized in accordance with the present invention to measure the strain present in spans 44, 46 and 48 of cable 42. The output of each strain measurement device 36 may be utilized, as explained herein, to control the paying out and rewinding of cable 42 during extension and retraction of mast 10. Anchor bases 32 also serve to mount detent pulleys 34 which each serve to receive and return a length of cable 42. After a review of the following disclosure, those skilled in the art will appreciate that each detent pulley 34 must be mounted to stanchion 38 at substantially the same vertical position and that this vertical position should be equal to the position of the source of cable 42 as it pays out of cable drive 64.

Still referring to FIG. 1, there is also depicted a support bracket 50 which is preferably mounted in a selected position to mast 10. Support bracket 50 serves to mount metering sprockets 52, 54 and 56 along with various guidance and synchronization equipment illustrated below. As can be seen, the mast support system of the present invention utilizes a single continuous length of cable 42 which is threaded from supply reel 40 through cable drive 64 to metering sprocket 54 on support bracket 50 along span 44. From metering sprocket 54 cable 42 is threaded through detent pulley 34 at anchor base 32 and back to metering sprocket 56 along span 46. Similarly, cable 42 is threaded from metering sprocket 56 through detent pulley 34 at anchor base 32 and back to metering sprocket 52 along span 48. Finally, cable 42 is threaded from metering sprocket 52 to stanchion 38 on cable supply anchor base 30 along span 43. Of course, it will be apparent upon reference to FIG. 1, that each anchor base also includes a strain measurement device 36 which is coupled to a section of the cable span near that anchor point.

Figure 2:
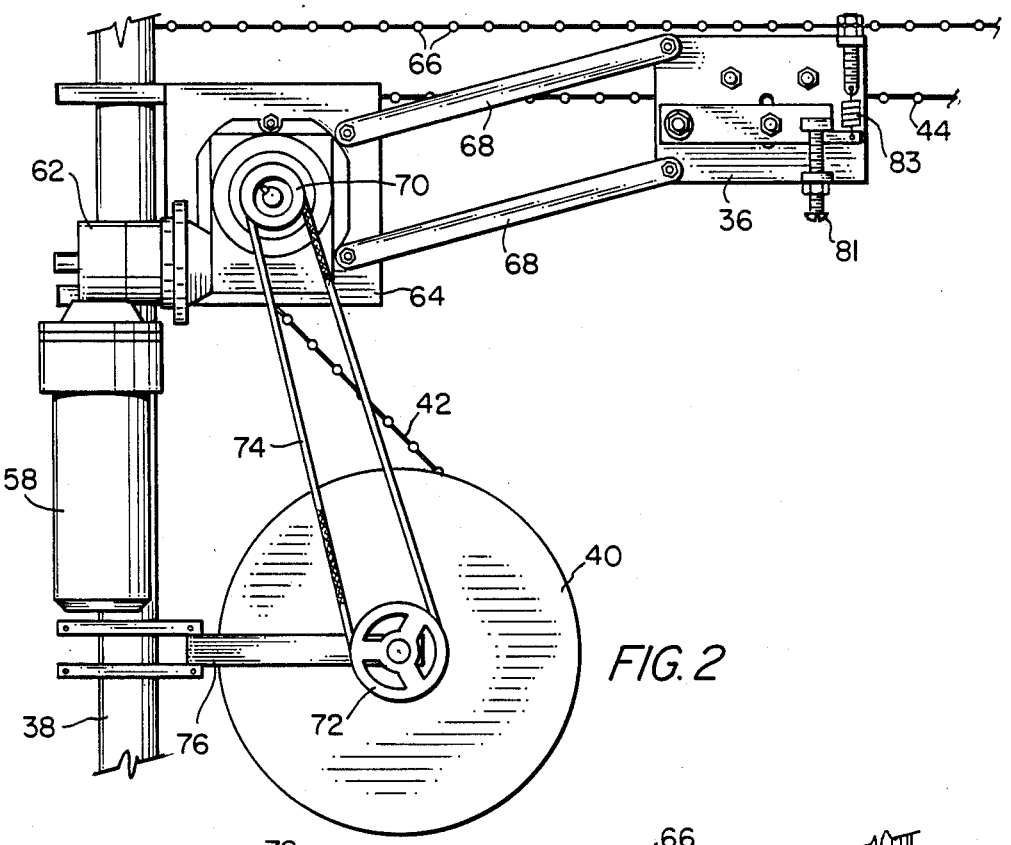
FIG. 2 is a partial view of one side of the cable drive and supply section of the extensible mast support system of the present invention.

With reference now to FIG. 2, there is depicted a partial view of one side of cable supply anchor 30 of the present invention. As can be seen, supply reel 40 is mounted to stanchion 38 by means of reel support bracket 76. Controllable drive motor 58 is mechanically coupled, through transmission 62 ,to cable drive 64. As those skilled in the art will appreciate, controllable drive motor 58 may be selectively operated to rotate cable drive pulley 70 which is coupled to reel drive pulley 72 by means of flexible drive belt 74. In this manner, operation of cable drive 64 will cause rotation of supply reel 40. While it is obvious that extension of mast 10 and pay out of cable 42 by cable drive 64 could be accomplished without the necessity of driving supply reel 40, it should be recalled that automatic rewind of cable 42 is required during retraction of mast 10 (see FIG. 1). Thus, during rewind of cable 42 drive belt 74, co-acting with cable drive pulley 70 and reel drive pulley 72 will serve to rewind cable 42 on supply reel 40.

Pivotally mounted to cable drive 64 by members 68 is strain measurement device 36. The depicted embodiment of strain measurement device 36 can best be understood by simultaneous reference to both FIGS. 2 and 3. As can be seen, strain measurement device 36 includes two fixed tension rollers 78, which are preferably pulleys or other devices adapted with detents to receive each bead 66 of cable 42. Movable tension roller 80 is similarly constructed and is preferably mounted in a manner which will permit movement in a substantially vertical manner when disposed as depicted in FIG. 3.

As can be seen, a spring 83 and adjustment screw 81 are provided and may be utilized to bias the initial position of movable tension roller 80 in a raised position. It should be apparent from reference to the foregoing that while cable 42 is not under tension or strain, movable tension roller so will move upward in response to the bias of spring 83, deflecting cable 42 upward from the depicted horizontal position. As longitudinal tensile strain is increased on cable 42, movable tension roller 80 will be forced downward, against the bias provided by spring 83. Those skilled in this art will appreciate that the movement of movable tension roller 80 may by utilized to operate a potentiometer or make an electrical contact to provide an indication of the strain present in cable 42. This indication may be provided remotely by electrically coupling each strain measurement device 36 to a central control device 60.

Figure 3:
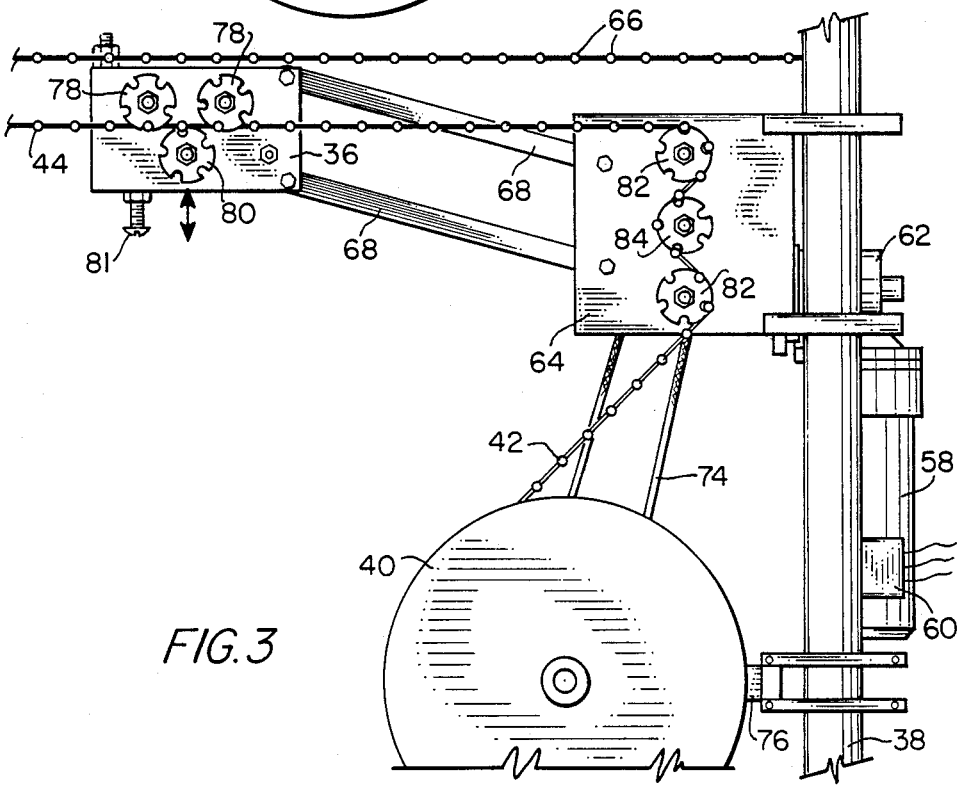
FIG. 3 is a partial view of the other side of the cable drive and supply section of the extensible mast support system of the present invention.

Referring more specifically now to FIG. 3, the operation of cable drive 64 may be illustrated. As is depicted, cable drive 64 preferably includes a plurality of detent rollers similar to those present in each strain measurement device 36. Two of such rollers are preferably idler drive rollers 82 while a third roller, drive roller 84, is operatively coupled through transmission 62 to controllable drive motor 58. It should be apparent that during rotation of drive roller 84 cable 42 may be driven through cable drive 64 in either direction. As illustrated below, control device 60 may be utilized to direct the operation of controllable drive motor 58 in response to the outputs of strain measurement devices 36, or in an alternate embodiment, a human operator may observe the outputs of strain measurement devices 36 and direct controllable drive motor 58 manually.

Figure 4:
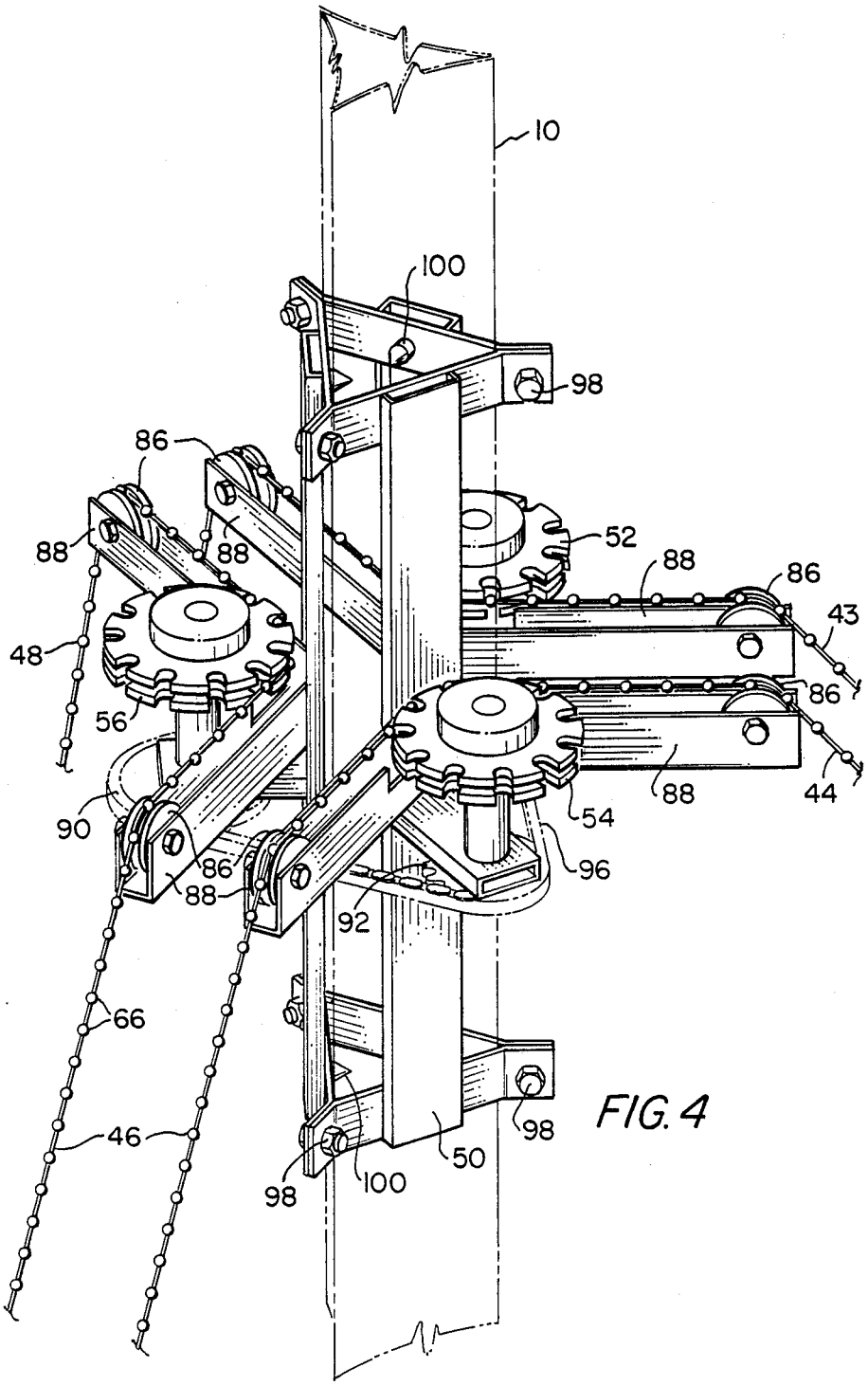
FIG. 4 is a perspective view of the support bracket and metering sprockets of the extensible mast support system of the present invention.

With reference now to FIG. 4, there is depicted a more detailed perspective view of support bracket 50 of the novel support system of the present invention. As is illustrated, support bracket 50 is preferably fixedly mounted to mast 10 by utilization Of a plurality of bolts 98. Additionally, multiple mounting pins 100 may also be utilized in conjunction with apertures in mast 10 to ensure support bracket 50 remains in a stable position on mast 10. Support bracket 50 is preferably mounted to mast 10 at a selected point as mast 10 is erected. As disclosed earlier, in applications in which mast 10 will achieve a sufficient height it may be desirable to attach a second support bracket 50 to mast 10 is to serve in conjunction with a second set of anchor points. Fixedly mounted to support bracket 50 are multiple metering sprockets 52, 54 and 56. As can be seen, each metering sprocket includes a plurality of detents, each adapted to receive a bead 66 when cable 42 is threaded through the metering sprockets.

As previously described in less detail, cable 42 may be threaded along span 44 to a guide roller 86 which is rotatably mounted to guide roller support 88. Cable 42 then engages metering sprocket 54 and passes over a second guide roller to form span 46. Upon returning from detent pulley 34 (see FIG. 1) span 46 engages another guide roller 86 and is threaded into contact with metering sprocket 56. Another pair of guide rollers 86 are utilized to form span 48 and cable 42 is finally coupled to metering sprocket 52 from whence it returns to cable supply anchor base 30 as span 43.

As may be partially viewed in FIG. 4, metering sprockets 52, 54 and 56 are each directly coupled by a shaft (not shown) to a respective metering sprocket drive gear 90, 92 and 94 (not shown). A chain belt 96 is then utilized to synchronize rotation of metering sprockets 52, 54 and 56 in a manner consistent with the disclosure of the present invention. The operation of metering sprocket drive gears 90, 92 and 94 and further advantages of this invention may be more easily understood upon reference to FIG. 5.

Figure 5:
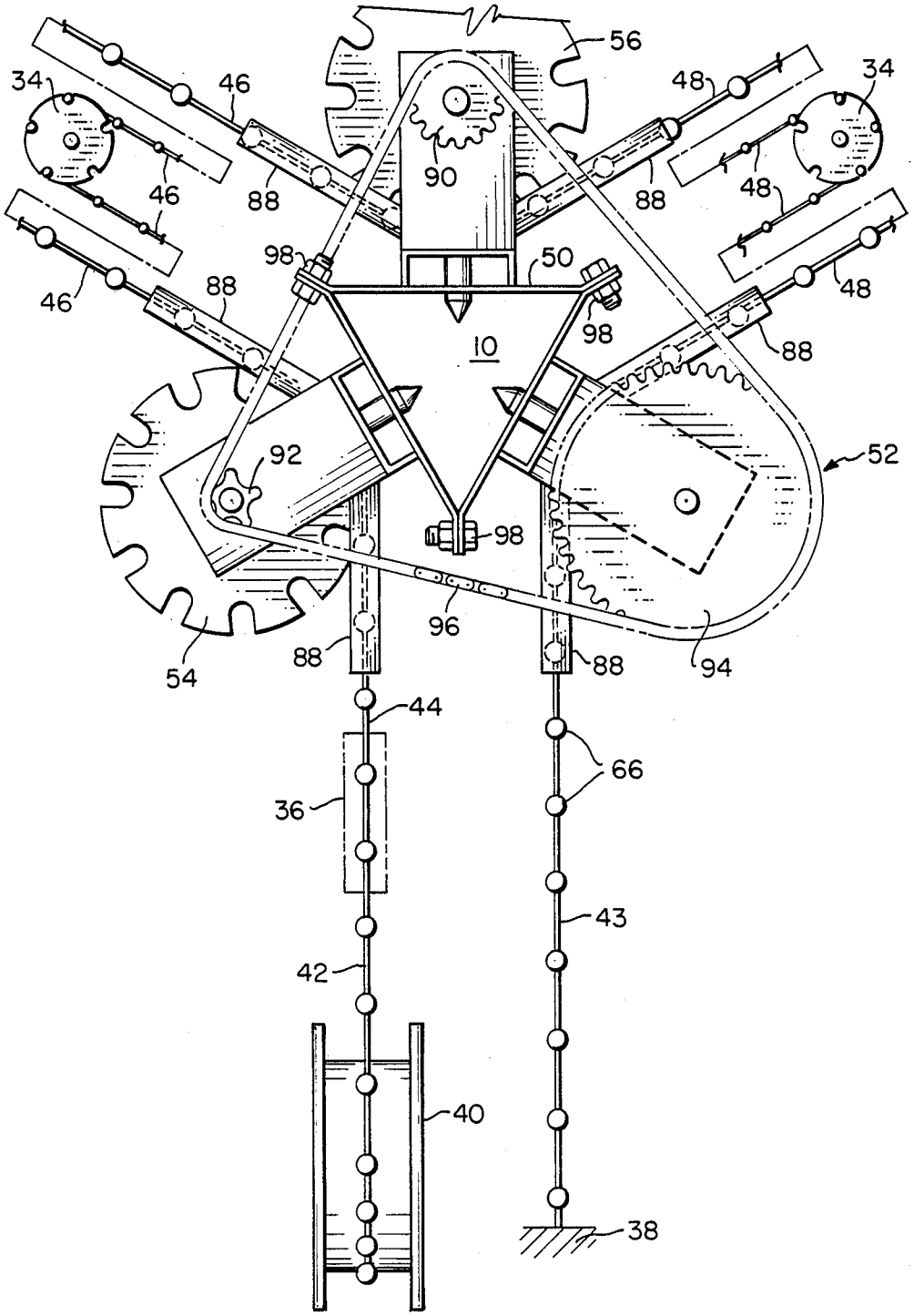
FIG. 5 is a bottom view of the metering sprocket drive system of the extensible mast support system of the present invention.

FIG. 5 depicts a bottom view of support bracket 50 of the novel support system of the present invention and clearly illustrates the interaction of metering sprocket drive gears 90, 92 and 94. As may be seen, although metering sprockets 52, 54 and 56 are of substantially identical diameters, metering sprocket drive gears 90, 92 and 94 vary in diameter in a precise relationship. This relationship is responsible for the novel manner in which a single length of continuous cable 42 may be utilized to provide multiple independent guy wires. As illustrated, metering sprocket drive gear 92 includes five gear teeth, metering sprocket drive gear 90 includes fifteen gear teeth and metering drive gear 94 includes forty-five gear teeth, each gear tooth being spaced a substantially equal distance from its adjoining gear teeth in each metering sprocket drive gear by varying the diameter thereof so that a single chain belt can drive each metering sprocket drive gear.

Chain belt 96 couples each metering sprocket drive gear together and limits independent rotation of any individual metering sprocket drive gear. Thus, each rotation of metering drive gear 90 will Cause three rotations of metering sprocket drive gear 92 and one-third of one rotation of metering sprocket drive gear 94. Recalling that metering sprockets 52, 54 and 56 are directly coupled to their associated metering sprocket drive gear and that each metering sprocket is substantially identical in diameter, it should be apparent that longitudinal movement along each span of cable 42 will vary in accordance with the gear ratios depicted.

It will facilitate the understanding of this aspect of the present invention if the reader will consider the paying out of additional cable 42 from cable supply reel 40 to each individual pan in a discreet step-by-step manner. Thus, should cable 42 pay out from supply reel 40 a total of six beads 66, the forced rotation of metering sprocket drive gear 92 will cause metering sprocket 54 to advance five beads 66 to span 46, leaving the length of span 44 incremented by one bead.

Next, the rotation of metering sprocket drive gear 90 (in actuality occurring simultaneously with the rotation of metering sprocket drive gear 92) will drive metering sprocket 56, advancing three beads 66 and augmenting the length of span 46 by one bead 66 on each leg thereof. Finally, metering sprocket drive gear 94 also rotates, driving metering sprocket 52 and advancing one bead 66 onto span 43, augmenting the length of span 48 by one bead on each leg thereof. In this manner, each guy wire formed by a span of cable 42 has been incremented by an equal amount of length.

It should now be apparent that while cable drive 64 is immobilized, metering sprocket drive gears 90, 92 and 94 will similarly be immobilized. It follows then that metering sprockets 52, 54 and 56 will remain at rest, engaging various beads 66 from cable 42 and substantially restricting length variation in each span of cable 42 despite variations which may be present in the strain at each span.

The foregoing teaching is quite important as it is necessary to retain the desired geometry of all guy wires despite unequal strain present therein. For example, should a single span 46 be exposed to a tensile strain by a wind, it is necessary to prevent span 46 from increasing in length and consequently shortening the length of spans 48 and 44. The novel support system of the present invention allows this independent relationship to occur despite the utilization of a single length of continuous cable 42. By solving this problem, the Applicant has made the utilization of a single length of cable 42 and its concomitant ease of operation possible for multiple guy wire support systems.

The utilization of stress measurement devices 36 will now be described in conjunction with the erection or retraction of mast 10. As may be apparent, the necessary position of support bracket 50 will vary with climatic conditions and the height of mast 10 which is desired. It will however be necessary to fasten support bracket 50 to mast 10 during erection and pay out cable 42 as support bracket 50 rises with the erection of mast 10. Conversely, it will be necessary to rewind cable 42 as support bracket 50 is lowered while mast 10 retracts. A simple algorithm which may be easily adapted to automatic control is utilized to control the paying out and rewinding of cable 42 during extension or retraction of mast 10.

The output of each strain measurement device 36, in accordance with the present invention, is constantly scrutinized during erection and retraction of mast 10. During erection of mast 10, cable drive 64 will only pay out cable 42 when all three strain measurement devices 36 indicate cable 42 is under tension. During retraction of mast 10, cable drive 64 will rewind cable 42 when any one of strain measurement devices 36 indicates cable 42 is not under tension. In this manner, mast 10 may be erected or retracted, raising or lowering support bracket 50 while the novel support system of the present invention ensures that each span of cable 42 remains equal in length.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention,. It is therefore contemplated that the appended claims will cover any such modifications or embodiments that fall within the true scope of the invention.

What is claimed is:

1. An extensible mast support system for anchoring an elongate extensible mast having a base, said support system comprising:

an elongate extensible mast;

a plurality of anchor points each disposed radially distant from said base of said elongate extensible mast and spaced around the circumference thereof;

a support bracket fixedly mounted on said elongate extensible mast;

a single continuous length of cable extending sequentially from one of said anchor points to said support bracket, to at least a second of said anchor points forming a plurality of partial spans of said cable between each of said anchor points and said support bracket during extension, retraction and utilization of said elongate extensible mast; and means for substantially restricting length variations between partial spans of said single continuous variable length of cable which are disposed between one of said plurality of anchor points and said support bracket wherein variations in strain in a single such partial span will occur independently of variations in strain present in other such partial spans.

2. The extensible mast support system according to claim 1 wherein at least one of said plurality of anchor points comprises a pulley adapted to rotatably receive and return a partial span of said single continuous length of cable.

3. The extenible mast support system according to claim 1 wherein portion of said single continuous length of cable not linking each of said plurality of anchor points and said support bracket is stored on a single reel disposed adjacent to one of said plurality of anchor points.

4. The extensible mast support system according to claim 3 wherein said single reel is adapted to be rotated by a controllable electric motor.

5. The extensible mast support system according to claim 1 wherein said single continuous length of cable comprises a flexible cable having a plurality of beads disposed substantially equidistantly along the length thereof.

6. The extensible mast support system according to claim 5 wherein said means for substantially restricting length variations between partial spans of said single continuous length of cable which are disposed between one of said plurality of anchor points and said support bracket comprises means for engaging selected one of said plurality of beads disposed substantially equidistantly along the length of said single continuous length of cable.

7. An extensible mast support system for anchoring an elongate extensible mast having a base, said support system comprising:

an elongate extensible mast;

a plurality of anchor points each disposed radially distant from said base of said elongate extensible mast and spaced around the circumference thereof;

a support bracket fixedly mounted on said elongate extensible mast;

a single continuous length of cable extending sequentially from one of said anchor points to said support bracket, to at least a second of said anchor points forming a plurality of partial spans of said cable between each of said anchor points and said support bracket;

strain measurement means for measurement of strain present in each partial span of said single continuous length of cable disposed between one of said plurality of anchor points and said support bracket; and control means coupled to said strain measurement means for selectively varying the length of each partial span of said single continuous length of cable disposed between one of said plurality of anchor points and said support bracket in response to said strain measurement during extension and retraction of said elongate extensible mast.

8. The extensible mast support system according to claim 7 wherein said control means further includes means for varying the length of each partial span of said single continuous length of cable disposed between one of said plurality of anchor points and said support bracket by a substantially identical amount.

9. The extensible mast support system according to claim 7 wherein at least one of said plurality of anchor points comprises a pulley adapted to rotatably receive and return a partial span of said single continuous length of cable.

10. The extensible mast support system according to claim 7 wherein that portion of said single continuous length of cable not linking each of said plurality of anchor points and said support bracket is stored on a single reel disposed adjacent to one of said plurality of anchor points.

11. The extensible mast support system according to claim 10 wherein said single reel is adapted to be rotated by a controllable electric motor.

12. The extensible mast support system according to claim 11 wherein said control means is operatively connected to said controllable electric motor and wherein the length of the partial span of said single continuous variable length of cable disposed between each one of said plurality of anchor points and said support bracket is varied by selective operation of said controllable electric motor.

13. The extensible mast support system according to claim 7 further including means for substantially restricting length variations between partial spans of said single continuous length of cable disposed between each of one of said plurality of anchor points and said support bracket.

14. The extensible mast support system according to claim 13 wherein said single continuous variable length of cable comprises a flexible cable having a plurality of beads disposed substantially equidistantly along the length thereof.

15. The extensible mast support system according to claim 14 wherein said means for substantially restricting length variations between partial spans of said single continuous length of cable disposed between each one of said plurality of anchor points and said support bracket comprises means for engaging selected one of said plurality of beads disposed substantially equidistantly along the length of said single continuous length of cable.

16. An extensible mast support system for anchoring an elongate extensible mast having a base and means for extending and retracting said elongate extensible mast from said base, said support system comprising:

an elongate extensible mast;

a plurality of anchor points each disposed radially distant from said base of said elongate extensible mast and spaced around the circumference thereof;

a support bracket fixedly mounted on said elongate extensible mast, said support bracket including a plurality of metering sprockets, each of said plurality of metering sprockets being operatively coupled to all other metering sprockets wherein rotation of a single metering sprocket will result in simultaneous rotation of each metering sprocket;

a single continuous length of cable extending sequentially from one of said anchor points to one of said metering sprockets, to at least a second of said anchor points forming a plurality of partial spans of said cable between each of said anchor points and each of said metering sprockets during extension, retraction and utilization of said elongate extensible mast; and gear drive means coupled to said plurality of metering sprockets for controlling the rotation of each of said plurality of metering sprockets wherein variations in the length of said single continuous length of cable will result in an identical variation in the length of each partial span of said single continuous length of cable which is disposed between one of said plurality of anchor points and one of said plurality of metering sprockets.

17. The extensible mast support system according to claim 16 wherein at least one of said plurality of anchor points comprises a pulley adapted to rotatably receive and return a partial span of said single continuous length of cable.

18. The extensible mast support system according to claim 16 wherein said single continuous length of cable comprises a flexible cable having a plurality of beads disposed substantially equidistantly along the length thereof.

19. The extensible mast support system according to claim 18 wherein each of said plurality of metering sprockets includes means for engaging selected one of said plurality of beads disposed substantially equidistantly along the length of said single continuous length of cable.

20. The extensible mast support system according to claim 16 further including strain measurement means for measurement of strain present in each partial span of said single continuous length of cable disposed between one of said plurality of anchor points and one of said plurality of metering sprockets and control means coupled to said strain measurement means for a selectively varying the length of said single continuous length of cable in response to said strain measurement during extension and retraction of said elongate extensible mast.

* * * * *